US011236979B1

(12) United States Patent
Johnson

(10) Patent No.: US 11,236,979 B1
(45) Date of Patent: Feb. 1, 2022

(54) NON-LETHAL TRANQUILIZER BULLET

(71) Applicant: Gary Lee Johnson, Comstock Park, MI (US)

(72) Inventor: Gary Lee Johnson, Comstock Park, MI (US)

( * ) Notice: Subject to any disclaimer, the term of this patent is extended or adjusted under 35 U.S.C. 154(b) by 0 days.

(21) Appl. No.: 17/357,017

(22) Filed: Jun. 24, 2021

(51) Int. Cl.
*F42B 12/54* (2006.01)
*F42B 12/36* (2006.01)

(52) U.S. Cl.
CPC ..... *F42B 12/54* (2013.01)

(58) Field of Classification Search
CPC ..... F42B 12/36; F42B 12/362; F42B 12/54
USPC ..... 102/502, 512
See application file for complete search history.

(56) References Cited

U.S. PATENT DOCUMENTS 1,815,300 A * 7/1931 Harris ..... F42B 12/54 102/512
2,352,260 A * 6/1944 Herman ..... F42B 12/36 102/519
2,617,359 A * 11/1952 Van Horn ..... F42B 12/54 102/512
2,620,190 A * 12/1952 Bean ..... F42B 12/625 473/585
3,386,381 A * 6/1968 Ferb ..... F42B 12/54 102/512
3,502,025 A * 3/1970 Payne ..... F42B 12/54 102/512
3,584,582 A * 6/1971 Muller ..... F42B 12/54 102/512
3,754,509 A * 8/1973 Gogen ..... F42B 12/54 102/512
3,837,284 A * 9/1974 Waldeisen ..... F42B 12/54 102/512
3,901,158 A 8/1975 Ferb
(Continued)

FOREIGN PATENT DOCUMENTS

FR 2925151 6/2009

OTHER PUBLICATIONS

"Tranquillizer gun", downloaded at https://en.wikipedia.org/wiki/Tranquillizer_gun on Jun. 10, 2021, pp. 1-2.
(Continued)

*Primary Examiner* — Derrick R Morgan
(74) *Attorney, Agent, or Firm* — Warner Norcross + Judd LLP

(57) ABSTRACT

A non-lethal tranquilizer bullet is provided. The non-lethal tranquilizer bullet may include a housing defining an internal space and having a non-penetrating distal tip. A plunger assembly, a tranquilizer fluid, and at least one plunger stop may be disposed in the internal space. The plunger assembly can include a piston and a needle, and the needle may include a shaft terminating in a tip. The shaft may have a plurality of holes disposed along its length. When the bullet is fired from a gun and contacts a living body, the plunger assembly can move toward the non-penetrating distal tip such that the needle tip breaches the housing tip and enters the living body. The force of the plunger assembly moving forward may disperse the tranquilizer fluid into the living body through at least one of the plurality of holes. The plunger stop can prevent the piston from exiting the tip.

13 Claims, 4 Drawing Sheets

(56) References Cited

U.S. PATENT DOCUMENTS

| | | | | | |
|---|---|---|---|---|---|
| 4,598,096 | A * | 7/1986 | Grant | C06D 3/00 | 102/512 |
| 4,735,612 | A * | 4/1988 | Chevalier | F42B 12/54 | 102/512 |
| 4,798,143 | A * | 1/1989 | Graham | F42B 12/54 | 102/370 |
| 5,698,815 | A | 12/1997 | Ragner | | |
| 6,736,070 | B2 * | 5/2004 | Baltos | F42B 12/54 | 102/444 |
| 6,807,908 | B2 * | 10/2004 | Brydges-Price | F42B 12/54 | 102/451 |
| 7,013,810 | B1 * | 3/2006 | Brydges-Price | F42B 12/54 | 102/502 |
| 7,231,875 | B2 | 6/2007 | Rastegar | | |
| 9,151,582 | B2 * | 10/2015 | Scott | F42B 12/36 | |
| 9,664,486 | B2 * | 5/2017 | Scott | F42B 10/34 | |
| 2003/0029348 | A1 * | 2/2003 | Bailey | F42B 12/54 | 102/512 |
| 2003/0159612 | A1 | 8/2003 | Ziemack | | |
| 2003/0167955 | A1 * | 9/2003 | Baltos | F42B 12/54 | 102/512 |
| 2006/0086280 | A1 * | 4/2006 | Duong | F42B 12/54 | 102/502 |
| 2017/0038184 | A1 * | 2/2017 | Ankner | A61K 31/352 | |

OTHER PUBLICATIONS

"Riddick (2013)", downloaded at http://www.imfdb.org/wiki/Riddick_(2013) on Jun. 18, 2021, pp. 1-11.

* cited by examiner

NON-LETHAL TRANQUILIZER BULLET

BACKGROUND OF THE INVENTION

The present invention relates to non-lethal tranquilizer bullets, particularly to bullets with a plunger assembly to dispense a tranquilizer fluid.

Law enforcement officers are often required to enter situations where their safety is at issue. In order to resolve these situations, non-lethal force is often used. One non-lethal tool at officers' disposal is rubber bullets. Rubber bullets may deter another person, but generally will not incapacitate them. Another non-lethal tool at the officers' disposal are tranquilizer bullets. However, standard tranquilizer bullets can only be used in a tranquilizer gun, which requires officers to carry multiple weapons.

SUMMARY OF THE INVENTION

In one aspect, a non-lethal tranquilizer bullet is provided. The non-lethal tranquilizer bullet may include a housing defining an internal space. The housing can have a non-penetrating distal tip. A plunger assembly, a reservoir of tranquilizer fluid, and a plunger stop may be disposed in the internal space. The plunger assembly may include a piston and a needle. The needle may terminate in a needle tip and may include a shaft having a proximal opening and a distal opening. The plunger assembly can be movable between a first retracted position and a second extended position. The plunger stop may extend into the internal space between the piston and the non-penetrating distal tip. The plunger stop may define the second extended position and prevent the piston from exiting the housing. A seal can be coupled to the non-penetrating distal tip and may be configured to contain the tranquilizer fluid within the internal space of the housing. In response to the non-lethal tranquilizer bullet being discharged from a gun at a speed such that the non-penetrating distal tip contacts a living body without sufficient force to penetrate the skin of the living body, the plunger assembly may move from the first retracted position to the second extended position. The movement of the plunger assembly may occur with sufficient force for the needle tip to penetrate the seal and the skin of the living body. The movement of the plunger assembly may occur with sufficient speed that the needle tip exits the housing and penetrates the skin of the living body before the bullet deflects off the living body. The force of the movement of the plunger assembly can be sufficient to push the tranquilizer fluid through the proximal opening of the needle shaft, out the distal opening, and into the living body.

In one aspect, the non-lethal tranquilizer bullet may also include a needle equalizer to retract the needle. In such an aspect, as the plunger assembly moves from the first retracted position to the second extended position, the force is sufficient to not only puncture the seal and skin of a body, but also sufficient to compress the needle equalizer. A restorative force of the needle equalizer may extend the needle equalizer thereby moving the plunger assembly back from the second position to the first position. The needle equalizer can be disposed about the needle and adjacent the piston.

In one aspect, the non-lethal tranquilizer bullet may include at least one bore in a wall of the housing. The bore may extend between a first opening and a second opening in the wall of the housing. When the non-lethal tranquilizer bullet is fired from a gun, the air travelling through the bore may cause a whistling sound.

These and other objects, advantages, and features of the invention will be more fully understood and appreciated by reference to the description of the current aspect and the drawings.

Before the aspects of the invention are explained in detail, it is to be understood that the invention is not limited to the details of operation or to the details of construction and the arrangement of the components set forth in the following description or illustrated in the drawings. The invention may be implemented in various other aspects and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various aspects. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components. Any reference to claim elements as "at least one of X, Y and Z" is meant to include any one of X, Y or Z individually, and any combination of X, Y and Z, for example, X, Y, Z; X, Y; X, Z; and Y, Z.

DESCRIPTION OF THE CURRENT ASPECTS

Figure 1:
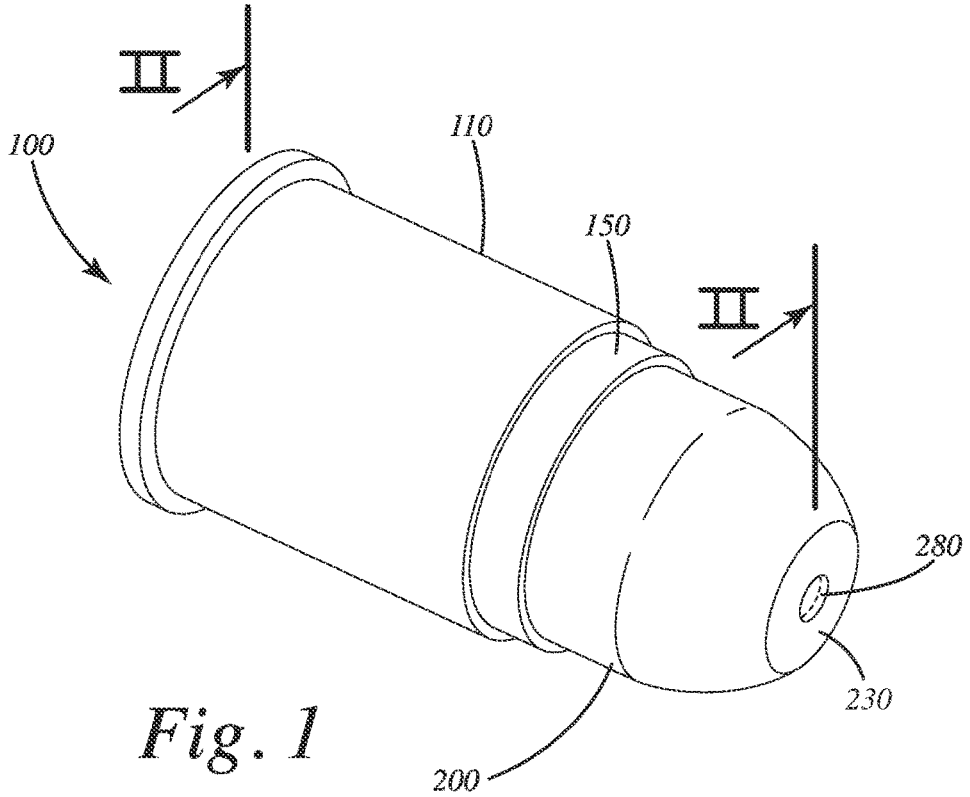
FIG. 1 is a perspective view of a non-lethal tranquilizer cartridge according to one aspect.

FIG. 1 depicts a perspective view of a non-lethal tranquilizer cartridge 100 according to one aspect. The non-lethal tranquilizer cartridge 100 may be a self-contained unit. The non-lethal tranquilizer cartridge 100 may include a non-lethal tranquilizer bullet 200 and a shell casing 110. The shell casing 110 can be a standard shell casing of any standard caliber size. For example, the shell casing 110 may be 9 millimeter, 38 caliber, 40 caliber, 45 caliber, 12 gauge, or any other standard shell casing size sufficient to discharge the non-lethal tranquilizer bullet at a suitable velocity.

Manufacturing the non-lethal tranquilizer cartridge 100 to be a standardized cartridge size can allow the non-lethal tranquilizer cartridge 100 to be discharged from a standard gun that accepts the respective cartridge size. This can allow law enforcement officers to only carry one gun and switch between regular bullets and non-lethal tranquilizer bullets 200 as desired. In one aspect, the non-lethal tranquilizer cartridge 100 may have a marker (for example, a different color bullet) to distinguish the non-lethal tranquilizer cartridge 100 from the standard cartridge. A plurality of non-lethal tranquilizer cartridges 100 can be installed in a clip or magazine to allow a user easier access to the tranquilizer bullets 200. In one aspect, the clip or magazine may include a marker (for example, a certain color stripe, a "T" for tranquilizer, a radio-frequency identification (RFID) tag, or other confirmation indicia) to distinguish the non-lethal tranquilizer clip or magazine from a standard live ammunition clip or magazine. The non-lethal tranquilizer cartridge 100 may allow law enforcement officers and others to mitigate violence against them in a non-lethal way using their standard issue lethal weapons.

Figure 2:
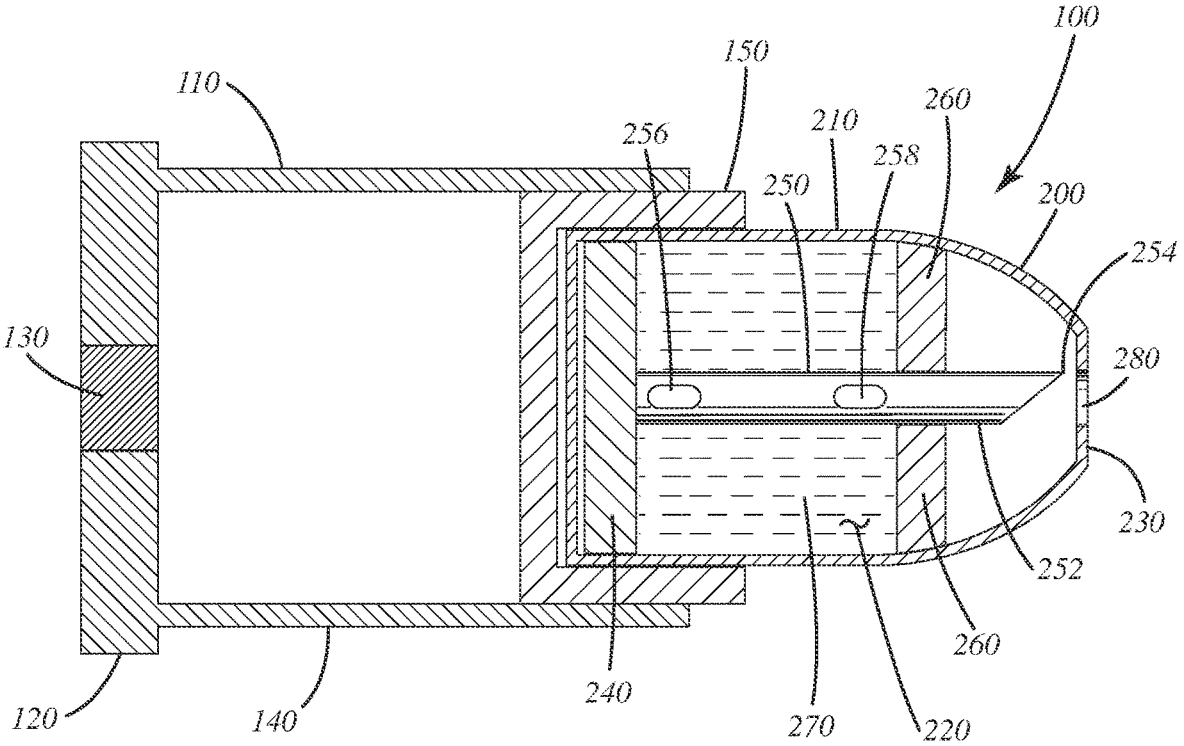
FIG. 2 is a side cross-sectional view of the non-lethal tranquilizer cartridge of FIG. 1 along the line II-II.

In FIG. 2, a side cross-sectional view of the non-lethal tranquilizer cartridge 100 of FIG. 1 along the line II-II is shown. The bullet 200 may be positioned in the shaft 140 of the shell casing 110. The shell casing 110 may include a base 120 and a shaft 140 extending from the base. The base 120 may include a primer 130 (also known as an initiator). The shaft 140 can define an opening therein for storing a propellant. The propellant may be referred to as a low charge propellant. In one aspect, the propellant may be gun powder, carbon dioxide ($CO_2$), compressed air, or another suitable charge. The primer 130 and the propellant can be selected to provide the non-lethal tranquilizer bullet 200 sufficient velocity when discharged to travel a suitable distance to reach a target living body while limiting the impact force on the living body to ensure the exterior surface of the bullet 200 does not penetrate the living body and the tranquilizer delivery system operates as intended. For example, the bullet 200 may travel at 250 feet per second (ft/s) with an effective range of approximately sixty-five feet whereas a 115 grain 9 mm lethal round may travel at 1,180 fps. The primer 130 can initiate the reaction of the propellant such that the non-lethal tranquilizer cartridge 100 exits the gun and the non-lethal tranquilizer bullet 200 is released from the shell casing 110. In one aspect, the gun may not automatically eject the spent cartridge 100 when the gun is fired. The gun may manually eject the spent cartridge in a variety of ways depending on the type of gun. For example, a striker fired gun can have the guide manually pulled back and released after each round is discharged which can enable the gun to fire the next round.

In one aspect, a partial cap 150 may be included in the non-lethal tranquilizer cartridge 100. The partial cap 150 can be cylindrically shaped without one of its front circular surfaces. The bullet 200 can be partially seated within the partial cap 150 as shown in FIGS. 1-2. The partial cap 150 can prevent the propellant (not shown) from escaping around the housing 210 as the non-lethal tranquilizer cartridge 100 is moved by sealing the connection between the shell casing 110 and the non-lethal tranquilizer bullet 200. The partial cap 150 may be made from copper, cupronickel, or any other suitable material. If the bullet 200 is made from a soft material, then the partial cap 150 may be included between the shell casing 110 and the non-lethal tranquilizer bullet 200 to seal a compression fit between the shell casing 110 and the bullet 200. The partial cap 150 may also be referred to as a jacket.

The bullet 200 can include a housing 210 defining an internal space 220 and a non-penetrating distal tip 230. The non-penetrating distal tip 230 may alternatively be referred to as the bullet head. The non-penetrating distal tip 230 is referred to as such because the tip of the bullet 200 does not penetrate human skin at typical impact speeds resulting from typical operation of a gun using non-lethal tranquilizer bullets 200. In some aspects, the non-penetrating distal tip 230 can be blunt. The non-penetrating distal tip 230 can hermetically seal the internal space 220 of the non-lethal tranquilizer bullet 200 from an external atmosphere. In one aspect, the non-penetrating distal tip 230 may include a break-resistant portion that is resilient to human skin at firing velocity. In some aspects, the break-resistant portion may be made from rubber. In one aspect, the non-lethal tranquilizer bullet 200 may be made from rubber, soft plastic, or another material that will not penetrate a living body when the bullet 200 is discharged from a gun and contacts the living body. In another aspect, the amount of friction between the plunger assembly and the housing 210 can be set to prevent the piston 240 from exiting the housing 210 when the plunger assembly moves from a retracted position to an extended position based on the firing force of the given bullet 200.

A plunger assembly may be positioned in the internal space 220 and may include a piston 240 and a needle 250. The plunger assembly may be normally concealed in the non-lethal tranquilizer bullet 200. The needle 250 may have a shaft 252 terminating in a needle tip 254. In one aspect, the needle tip 254 may define an opening. In another aspect, the needle tip 254 may be sealed.

Figure 3:
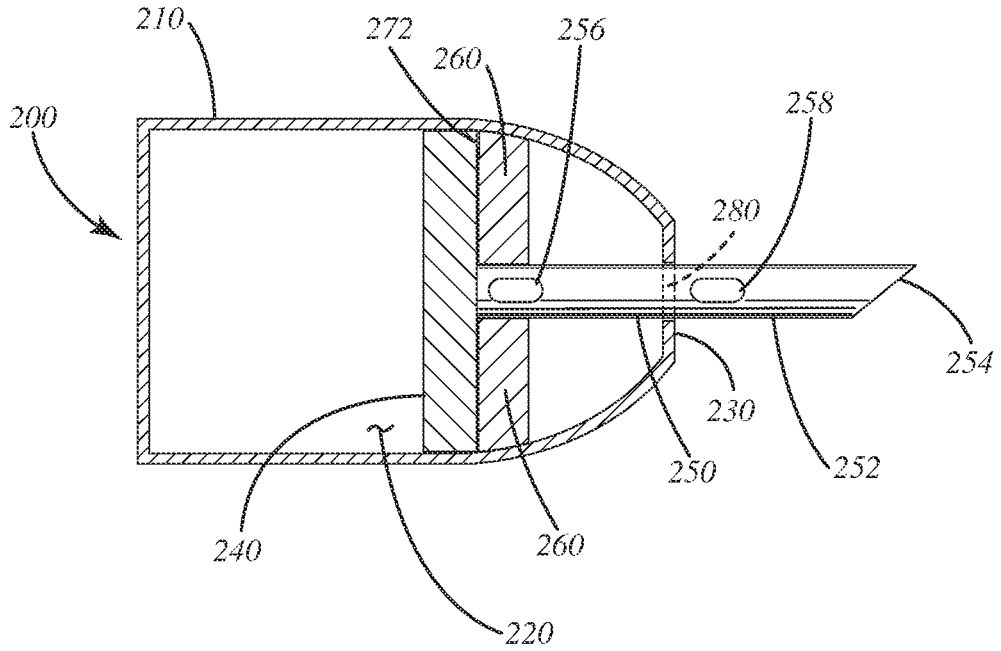
FIG. 3 depicts a side cross-sectional view of a non-lethal tranquilizer bullet of FIG. 2 with a plunger assembly in a second extended position.

The needle shaft 252 may have a plurality of openings including at least a proximal opening 256 and a distal opening 258. As depicted, the distal opening 258 can be located in the needle shaft 252 behind a plunger stop 260 when the plunger assembly is in the retracted position. In an alternative aspect, the distal opening 258 may be located in the needle shaft 252 parallel to the plunger stop 260 or ahead of the plunger stop 260 toward the non-penetrating distal tip 230. The needle shaft 252 may be in fluid communication with a reservoir of tranquilizer fluid 270. The plunger assembly can be moved between a first retracted position as shown in FIG. 2 and a second extended position as shown in FIG. 3. The extended position may alternatively be referred to as a forward injection position. In one aspect, the piston 240 may contact the inner surface of the housing 210 to prevent a portion of the reservoir of tranquilizer fluid 270 from leaking behind the piston 240 as the plunger assembly moves from the retracted position to the extended position. In an alternate aspect, the piston 240 may not contact the inner surface of the housing 210.

The non-lethal tranquilizer bullet 200 may also include the plunger stop 260 extending into the internal space 220 between the piston 240 and the non-penetrating distal tip 230. As depicted, the plunger stop 260 can extend into the internal space 220 to contact the needle shaft 252. The contact between the plunger stop 260 and the needle shaft 252 may help to guide the needle 250 as it exits the housing 210. In one aspect, the surface of the plunger stop 260 in contact with the needle shaft 252 may be curved to the curvature of the shaft 252 which may create a seal between the needle shaft 252 and the plunger stop 260 to prevent or reduce an amount of the reservoir of tranquilizer fluid 270 from leaking into another portion of the internal space 220 (for example, into the portion of the internal space between the plunger stop 260 and the non-penetrating distal tip 230). In an alternate aspect, the plunger stop 260 may extend into the internal space 220 but not so far as to come into contact with the needle shaft 252. The position of the plunger stop 260 defines the extended position and prevents the piston 240 from exiting the housing 210. The plunger stop 260 can be joined to the housing 210 or can be integral with the housing 210. In one aspect, the plunger stop 260 may include one protrusion into the internal space 220. In another aspect, the plunger stop 260 may include two protrusions spaced substantially 180° from each other in the internal space 220. In yet another aspect, the plunger stop 260 may be a single protrusion that spans the circumference of the internal space 220. In still another aspect, the plunger stop 260 can also extend toward the non-penetrating distal tip 230 to guide the needle 250 as it exits the housing 210 and the plunger stop 260 may contact the inner surface of the non-penetrating distal tip.

The non-lethal tranquilizer bullet 200 may include the reservoir of tranquilizer fluid 270. The tranquilizer fluid may alternatively be referred to as a tranquilizer liquid, a temporary paralyzing drug, tranquilizer drug, or simply tranquilizer. The tranquilizer fluid can render a living body temporarily incapacitated without long term or permanent side effects. In one aspect, the interior surface of the housing 210 can define the reservoir of tranquilizer fluid 270. In another aspect, a separate vessel within the internal space 220 may be included as a reservoir of tranquilizer fluid 270. In yet another aspect, the space between the piston 240 and the plunger stop 260 may define the reservoir of tranquilizer fluid 270 and the space between the plunger stop 260 and the inner surface of the non-penetrating distal tip 230 may be filled with air. In still another aspect, both the space between the piston 240 and the plunger stop 260 and the space between the plunger stop 260 and the inner surface of the non-penetrating distal tip 230 may contain the tranquilizer fluid. The non-lethal tranquilizer bullet 200 may have a seal 280 disposed at the non-penetrating distal tip 230. The seal 280 may alternatively be referred to as a soft sealant. In one aspect, the seal 280 may be a separate component coupled to the non-penetrating distal tip 230. In another aspect, the seal 280 may be integrated into the non-penetrating distal tip 230. In yet another aspect, the non-penetrating distal tip 230 may be formed by the seal 280. Put another way, the seal 280 and the non-penetrating distal tip 230 may be the same component. The seal 280 can be configured to contain the reservoir of tranquilizer fluid 270 within the internal space 220 of the housing 210. The seal material may remain in place after the initial impact of the bullet 200 with a living body and deployment of the needle 250, which pierces the seal 280. That is, the seal 280 can be configured such that, when pierced, it retains all or at least sufficient tranquilizer fluid of the reservoir within the internal space 220 of the housing 210 for effective tranquilizer delivery through the needle to the living body. In an aspect in which the reservoir of tranquilizer fluid 270 is contained in a separate vessel within the internal space 220, the movement of the plunger assembly from the retracted position to the extended position may rupture (for example, by piston pressure) the vessel and allow the tranquilizer fluid to flow through the needle 250.

When the non-lethal tranquilizer bullet 200 is discharged from a gun such that the non-penetrating distal tip 230 contacts a living body without sufficient force to penetrate the skin of the living body, the plunger assembly may move from the retracted position (FIG. 2) to the extended position (FIG. 3). The movement from the retracted position to the extended position can occur due to the inertia of the plunger assembly continuing to move the plunger assembly forward when the bullet 200 contacts the living body and stops its motion. The movement may occur with sufficient force for the tip 254 to puncture the seal 280 and the skin of the living body such that the needle 250 partially enters the living body. Put another way, the speed at which the bullet 200 contacts the living body will not cause the bullet 200 to penetrate the living body. Instead, the plunger assembly moves forward such that the needle 250 partially enters the living body based on the initial impact of the bullet 200 on the living body and before the bullet 200 deflects off the living body. In one aspect, the needle 250 may enter the living body a sufficient distance to dispense the tranquilizer fluid into the living body. That is, the needle tip 254 can pierce the living body and drive into the body a depth equal to or about the distance between the piston 240 and the plunger stop 260, which is sufficient for the distal needle shaft opening 258 to be fully enclosed by the interior of the living body.

The force of the movement can also be sufficient to push the tranquilizer fluid through the proximal opening 256 into the needle shaft 252 and out the distal opening 258 into the living body. As shown in FIG. 3, when the plunger assembly is in its extended position, a remaining space 272 between the piston 240 and the plunger stop 260 has a smaller volume than the total volume of the tranquilizer fluid. Therefore, the pressure caused by the plunger assembly moving to its extended position forces the tranquilizer fluid into the proximal opening 256 and into the needle shaft 252 because the remaining space 272 is insufficient for the volume of tranquilizer fluid. In an aspect in which the plunger stop 260 does not contact the needle shaft 252, the remaining space between the piston 240 and the inner surface of the non-penetrating distal tip 230 when the plunger assembly is in the extended position has a smaller volume than the total volume of the tranquilizer fluid.

Figure 5:
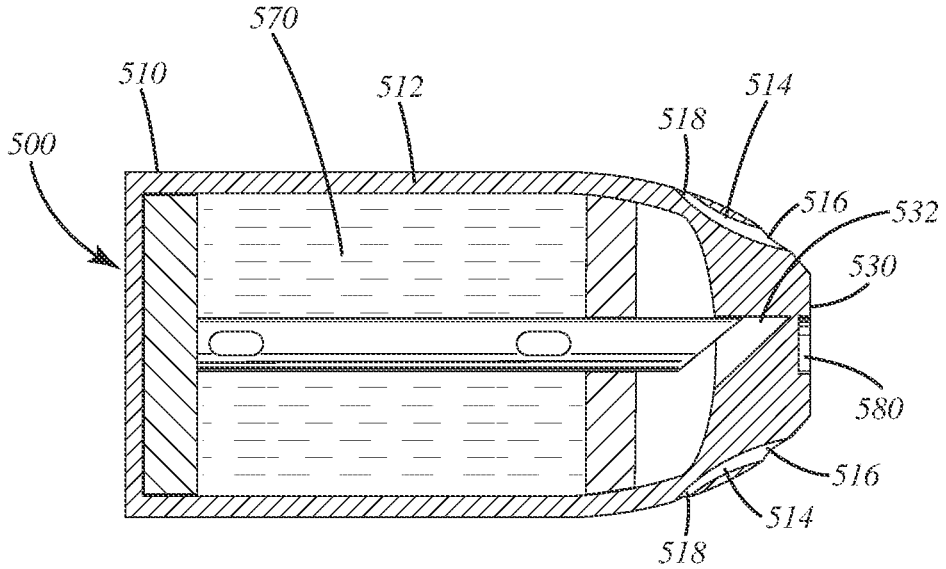
FIG. 5 shows a side cross-sectional view of a non-lethal tranquilizer bullet according to one aspect.

As shown in FIG. 5, the non-lethal tranquilizer bullet 500 may include a slit 532 in the non-penetrating distal tip 530. The slit 532 may extend partially into the non-penetrating distal tip 530. The tip of the needle can be positioned in the slit 532 so that the slit 532 supports and aligns the needle as it exits the distal tip 530 through the seal 580. The slit 532 may ensure the needle maintains its angle and proper alignment with respect to the housing 510 as it exits the housing 510. The slit 532 can also allow the needle to exit the housing 510 as it contacts a living body more easily because the slit 532 provides at least a partial channel in the non-penetrating distal tip 530 through which the needle can pass. Additionally, or alternatively, the non-penetrating distal tip 530 may include one or more fractures or breakaway portions to ease the passage of the needle through the non-penetrating distal tip 530. In one aspect, the slit may be in the seal 580 when the seal 580 acts as a plug in the non-penetrating distal tip 530 or when the seal 580 is the non-penetrating distal tip 530.

Figure 4A:
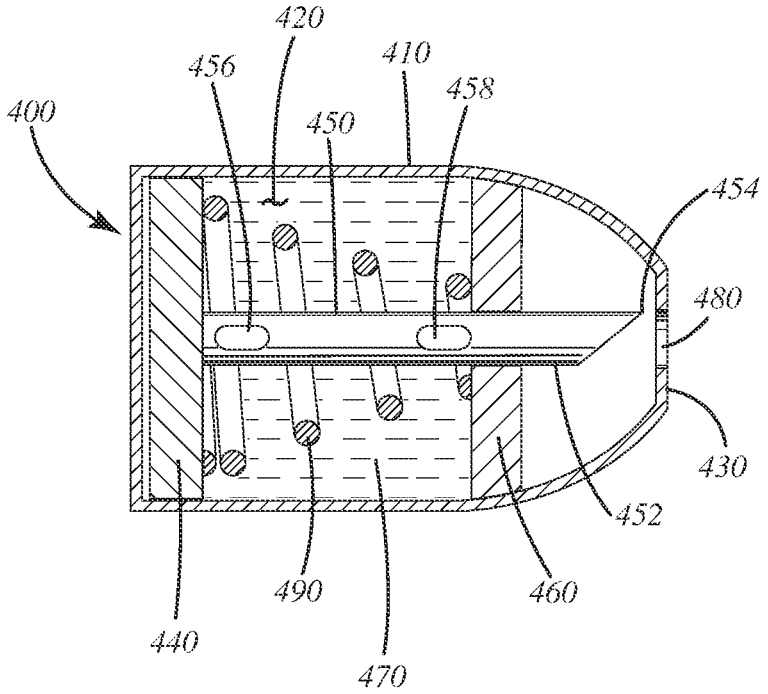
FIGS. 4A-4C show side cross-sectional views at different stages of a non-lethal tranquilizer bullet including a needle equalizer according to one aspect.
Figure 4B:
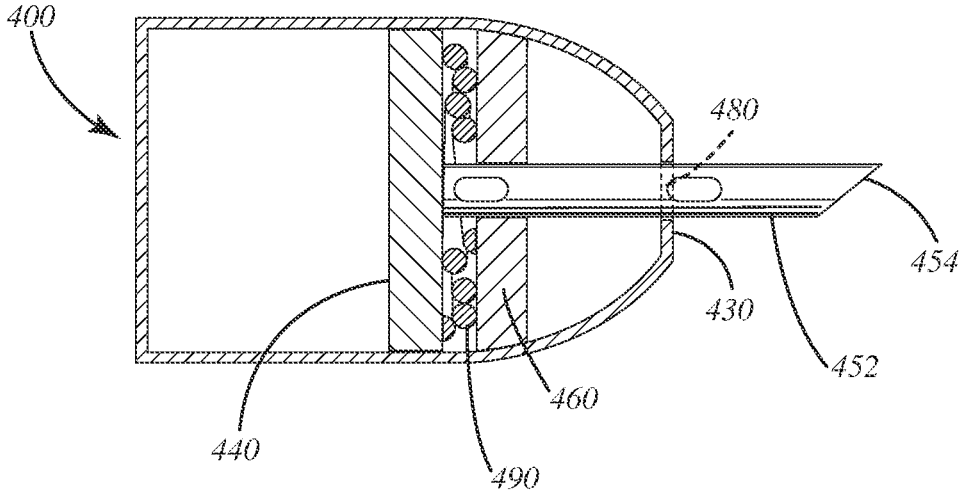
Figure 4C:
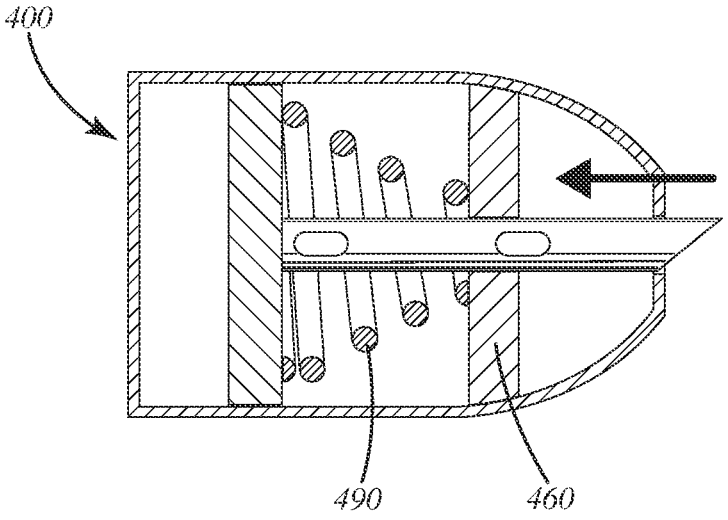

In FIGS. 4A-4C, a method of operation of an alternate aspect of a non-lethal tranquilizer bullet 400 is shown. The non-lethal tranquilizer bullet 400 may have all of the components of the bullet 200 of FIGS. 1-3 denoted as a 400 series component instead of a 200 series component. The non-lethal tranquilizer bullet 400 can include a needle equalizer 490 disposed about the needle 450 and adjacent the piston 440. As depicted in FIGS. 4A-4C, the needle equalizer 490 is a compression cone spring. In alternative aspects, the needle equalizer 490 can be another type of spring, foam, or another compressible element. As depicted, the needle equalizer 490 may be disposed about the needle 450, adjacent the piston 440 at one end, and adjacent the plunger stop 460 at the opposite end. In one aspect, the needle equalizer 490 may be secured at one end to the piston 440 and/or at the other end to the housing 210. In an alternative aspect, the needle equalizer 490 may not be secured at either end. In yet another aspect, the needle equalizer 490 may be disposed about the needle 450, adjacent the piston 440 at one end, and adjacent an inner surface of the non-penetrating distal tip 430 at the opposite end. The needle equalizer 490 may be compressed between the piston 440 and the inner surface of the non-penetrating distal tip 430 as the plunger assembly moves from the retracted position to the extended position.

FIG. 4A shows the non-lethal tranquilizer bullet 400 before it contacts a living body. As depicted, the needle equalizer 490 is in its extended position. FIG. 4B depicts the non-lethal tranquilizer bullet 400 as it contacts a living body. The plunger assembly is moved to its extended position and the needle equalizer 490 is compressed between the piston 440 and the plunger stop 460. A restorative force of the needle equalizer 490 may extend the needle equalizer 490 to its extended position after the living body has been injected with the tranquilizer fluid, and the restorative force may move the plunger assembly from the extended position to the retracted position. In FIG. 4C, the needle equalizer 490 is in the process of moving toward its extended position and the plunger assembly is moving toward its retracted position. In one aspect, the needle equalizer 490 can be selected to have a restorative force that allows the entire reservoir of tranquilizer fluid 470 to be administered to the living body before the needle 450 is retracted from the living body. The needle equalizer 490 may be described as returning the plunger assembly to the interior of the non-lethal tranquilizer bullet 400. The needle equalizer 490 may allow the needle 450 to be retracted into the housing 410 after the tranquilizer has been administered to reduce the risk of needlestick injuries when the bullet 400 is collected.

Figure 6:
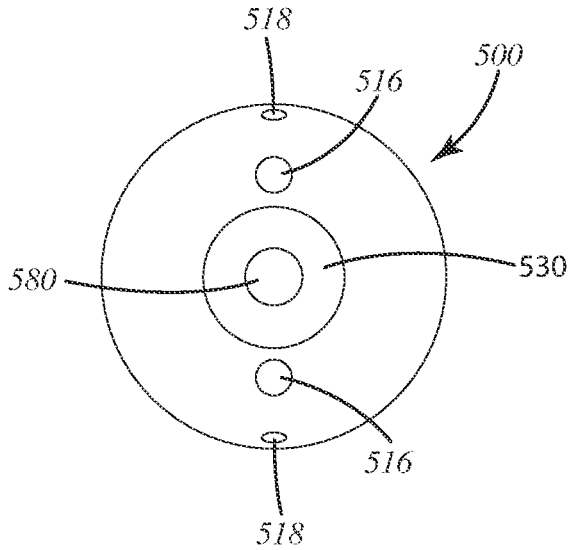
FIG. 6 depicts a front view of the non-lethal tranquilizer bullet of FIG. 5.

FIGS. 5-6 depict an alternative aspect of a non-lethal tranquilizer bullet 500. In FIG. 5, a side cross-sectional view of the bullet 500 is shown. The non-lethal tranquilizer bullet 500 may have all of the components of the non-lethal tranquilizer bullet 200 of FIGS. 1-3 denoted as a series 500 component rather than a series 200 component. The non-lethal tranquilizer bullet 500 can include at least one bore 514 disposed in a wall 512 of the housing 510. The bore 514 may alternatively be referred to as a whistle cavity. In one aspect, the bore 514 may be curved. As depicted, the non-lethal tranquilizer bullet 500 has two bores 514 located opposite each other in the wall 512 of the housing 510. In alternative aspects, the non-lethal tranquilizer bullet 500 may have any suitable number of bores 514. The bore 514 may extend between a first opening 516 and a second opening 518. The first opening 516 may alternatively be referred to as a front opening, and the second opening 518 may be referred to as a rear opening. FIG. 6 shows a front view of the non-lethal tranquilizer bullet 500 including a seal 580 and depicts one exemplary configuration of two of the first openings 516. In one aspect, the first opening 516 is near the non-penetrating distal tip 530 and the second opening 518 is located between the plunger stop 560 and the non-penetrating distal tip 530.

Returning to FIG. 5, the first opening 516 can be larger than the second opening 518 such that the non-lethal tranquilizer bullet 500 makes a whistling sound when it is fired from a gun. The whistling sound may alert the law enforcement officer that he or she has fired a non-lethal tranquilizer bullet 500 and not a lethal bullet. The whistling sound can have a physiological effect on and serve as a warning to the living body. Additionally, or alternatively, the whistling sound may alert the law enforcement officer that a "squib round" has not occurred. A squib round occurs when a projectile is fired but gets stuck in the barrel of the gun rather than leaving it. A squib round makes the gun unusable until it has been removed from the gun. The whistling sound can allow the law enforcement officer to know that a non-lethal tranquilizer bullet 500 has been fired and the barrel of his or her weapon is clear.

Directional terms, such as "vertical," "horizontal," "top," "bottom," "upper," "lower," "inner," "inwardly," "outer" and "outwardly," are used to assist in describing the invention based on the orientation of the aspects shown in the illustrations. The use of directional terms should not be interpreted to limit the invention to any specific orientation(s).

The above description is that of current aspects of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all aspects of the invention or to limit the scope of the claims to the specific elements illustrated or described in connection with these aspects. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed aspects include a plurality of features that are described in concert and that might cooperatively provide a collection of benefits. The present invention is not limited to only those aspects that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular.

The aspects of the invention in which an exclusive property or privilege is claimed are defined as follows:

1. A non-lethal tranquilizer bullet, the bullet comprising:

a housing defining an internal space, the housing including a non-penetrating distal tip;

a plunger assembly including a piston and a needle, the needle having a shaft terminating in a needle tip, the shaft having a proximal opening and a distal opening, the plunger assembly disposed within the internal space and being movable between a first retracted position and a second extended position;

a plunger stop, having at least two surfaces, the plunger stop extending into the internal space between the piston and the non-penetrating distal tip such that the at least two surfaces are disposed within the internal space, the plunger stop defining the second extended position and preventing the piston from exiting the housing;

a reservoir containing tranquilizer fluid; and a seal disposed at the non-penetrating distal tip, the seal configured to contain the reservoir of tranquilizer fluid within the internal space of the housing, wherein upon impact of the non-penetrating distal tip, the plunger moves from the first retracted position to the second extended position with sufficient force for the plunger assembly needle tip to puncture the seal and sufficient force for the plunger assembly piston to push the tranquilizer fluid through the proximal opening of the needle shaft and out the distal opening of the needle shaft.

2. The bullet of claim 1, comprising:

a slit in the non-penetrating distal tip, the needle tip positioned in the slit, wherein the slit supports and aligns the needle as the needle exits the non-penetrating distal tip so that the needle maintains its angle with respect to the housing.

3. The bullet of claim 2, wherein the slit extends only partially into the non-penetrating distal tip.

4. The bullet of claim 1, wherein the needle tip is enclosed.

5. The bullet of claim 1, wherein the plunger assembly includes a needle equalizer disposed about the needle and adjacent the piston, wherein the needle equalizer compresses as the plunger assembly moves from the first retracted position to the second extended position, and wherein a restorative force of the needle equalizer extends the needle equalizer to move the plunger assembly from the second extended position to the first retracted position.

6. The bullet of claim 1, wherein the bullet is incorporated into a cartridge to be used in a gun.

7. The bullet of claim 1, wherein the non-penetrating distal tip includes a rubber break-resistant portion.

8. The bullet of claim 1, wherein the non-penetrating distal tip is blunt, wherein the blunt non-penetrating distal tip hermetically seals the bullet from an atmosphere.

9. The bullet of claim 1, wherein the housing includes at least one bore disposed in a wall of the housing, the bore extending between a first opening near the non-penetrating distal tip and a second opening between the plunger stop and the non-penetrating distal tip, wherein the first opening is larger than the second opening causing a whistling sound when the bullet is discharged from a gun.

10. The bullet of claim 9, wherein the bore is curved.

11. The bullet of claim 1, wherein the plunger stop is at least one of joined to and integral with the housing.

12. The bullet of claim 1, wherein in the second extended position the proximal opening is located within the internal space and the distal opening is outside of the housing.

13. The bullet of claim 1, wherein the plunger stop extends into the internal space and contacts the shaft of the needle, wherein the plunger stop supports and aligns the needle as the needle exits the non-penetrating distal tip so that the needle maintains its angle with respect to the housing.

* * * * *